United States Patent [19]

Andra

[11] 3,987,133

[45] Oct. 19, 1976

[54] HUMIDIFIER

[75] Inventor: John R. Andra, Pittsburgh, Pa.

[73] Assignee: Fisher Scientific Company, Pittsburgh, Pa.

[22] Filed: Sept. 5, 1975

[21] Appl. No.: 610,571

[52] U.S. Cl. ..... 261/130; 261/131; 261/135; 261/136; 261/137; 261/142; 261/124

[51] Int. Cl.[2] ..... B01F 3/04

[58] Field of Search ..... 261/121 M, 124, 129, 261/130, 131, 135, 136, 137, 142

[56] References Cited

UNITED STATES PATENTS

| | | | |
|---|---|---|---|
| 3,209,124 | 9/1965 | Morrissey et al. | 261/142 X |
| 3,502,309 | 3/1970 | Flores | 261/130 |
| 3,638,926 | 2/1972 | Melville et al. | 261/142 X |
| 3,825,723 | 7/1974 | Roeser | 261/130 X |
| 3,864,440 | 2/1975 | Giocoechea | 261/142 X |

FOREIGN PATENTS OR APPLICATIONS

| | | | |
|---|---|---|---|
| 197,942 | 4/1908 | Germany | 261/124 |

*Primary Examiner*—Frank W. Lutter
*Assistant Examiner*—William Cuchlinski, Jr.
*Attorney, Agent, or Firm*—Webb, Burden, Robinson & Webb

[57] ABSTRACT

A humidifier for conditioning fluid for delivery to a test chamber, such as an incubator, includes means for automatically regulating the quantity, level and temperature of a body of water through which mixed gases, such as air and $CO_2$, are bubbled to entrain moisture in the gases. The water is heated to below its boiling point. The relative humidity of the saturated mixture delivered to the test chamber is usually at least 90% at temperatures between about 30° – 60°C.

9 Claims, 6 Drawing Figures

HUMIDIFIER

FIELD OF THE INVENTION

This invention relates to a humidifier which has means for automatically regulating the quantity, level and temperature of a body of water through which mixed gases, such as air and $CO_2$, are bubbled to entrain moisture in the gases for delivery to a test chamber or the like.

BACKGROUND OF THE INVENTION

Test chambers having carefully controlled environments are in common use in laboratories engaged in biological research. These environments must be maintained at appropriate humidity levels to avoid adverse effects upon the specimen or specimens under consideration. Usually it is important to maintain a test chamber environment at a high relative humidity and preferably at least 90% relative humidity through a temperature range of about 30° – 40° C. Some environments require a relative humidity of at least 90% through a range of temperatures to 60° C. The required humidity of the environment is provided and maintained by a humidifier.

Although the principles of humidifying air are well developed, heretofore laboratory humidifiers have included a type in which water has been heated in a chamber and gases have been bubbled through the water; no control was maintained over the water level or the temperature and thus no effective control was placed on the relative humidity being provided to the test chamber. In another type humidifier, the temperature, gas input and relative humidity of the humidifier are preset and not adjusted automatically to compensate for changes in the test chamber environment. Some humidifiers have operated at temperatures above the boiling point of water, such as that disclosed in U.S. Pat. No. 3,502,309.

This invention is a distinct improvement over those of the prior art in that it is a compact humidifier which provides the correct environment in a test chamber using automatic regulation of water level, quantity and temperature in the humidifier and maintains that environment at a substantially constant humidity responsive to control by the test chamber. Other features and advantages of the invention will be apparent from the following disclosure.

DESCRIPTION OF THE INVENTION

A humidifier according to the present invention comprises an insulated housing having a water inlet, a gas inlet and a fluid outlet which is connected to a test chamber, such as an incubator. Means, such as an electro-magnetic float, are provided for regulating the quantity and level of the body of water provided by water admitted to the housing. There is an immersion heater for heating the water in the humidifier to an appropriate temperature below the boiling point of water and a probe, electrically connected to the heater through a control circuit connected to the test chamber heater, for monitoring the temperature of the body of water in the humidifier and controlling the immersion heater to maintain the water temperature constant. A mixture of gases, such as air and $CO_2$, is introduced to the humidifier through the gas inlet and bubbled through the body of water to produce a conditioned fluid comprising a mixture of gases saturated to at least 90% relative humidity which is delivered through the fluid outlet to a test chamber.

DESCRIPTION OF THE PREFERRED EMBODIMENTS OF THE INVENTION

Figure 1:
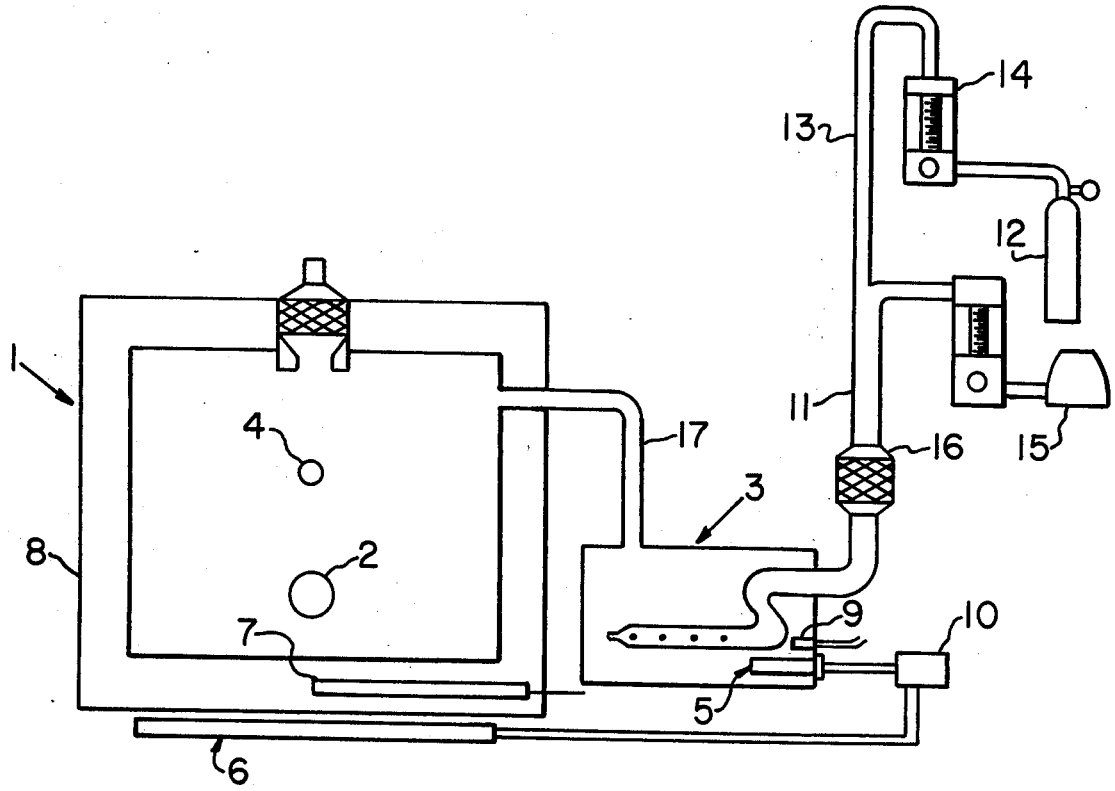
FIG. 1 is a schematic gas flow diagram of the humidifier according to the invention connected to a test chamber.
Figure 2:
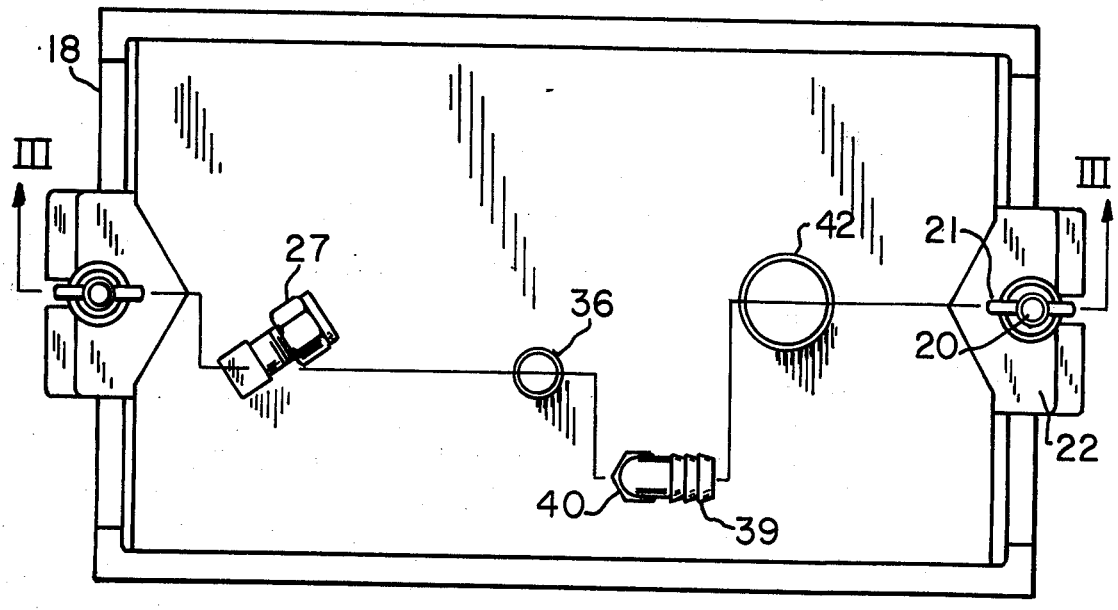
FIG. 2 is a plan view of the humidifier.
Figure 3:
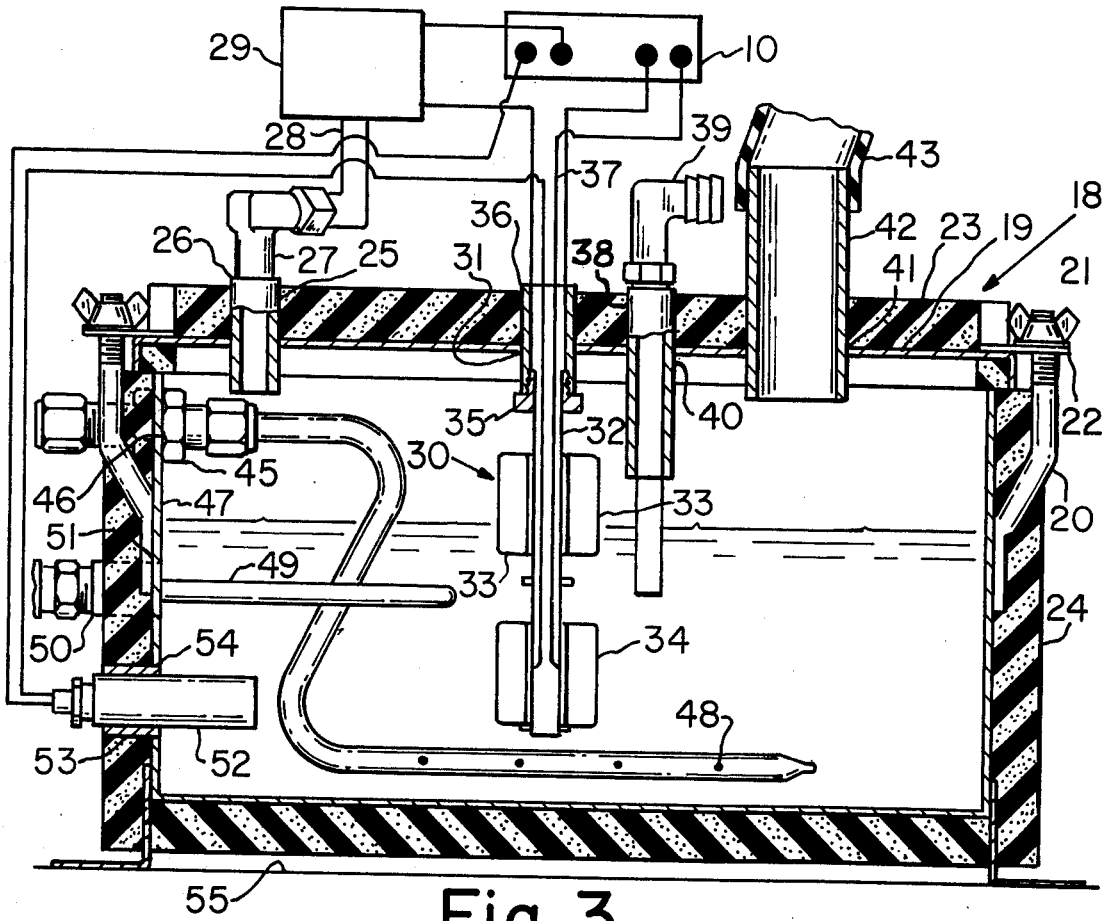
FIG. 3 is a cross-sectional view taken along lines III—III of FIG. 2.
Figure 4:
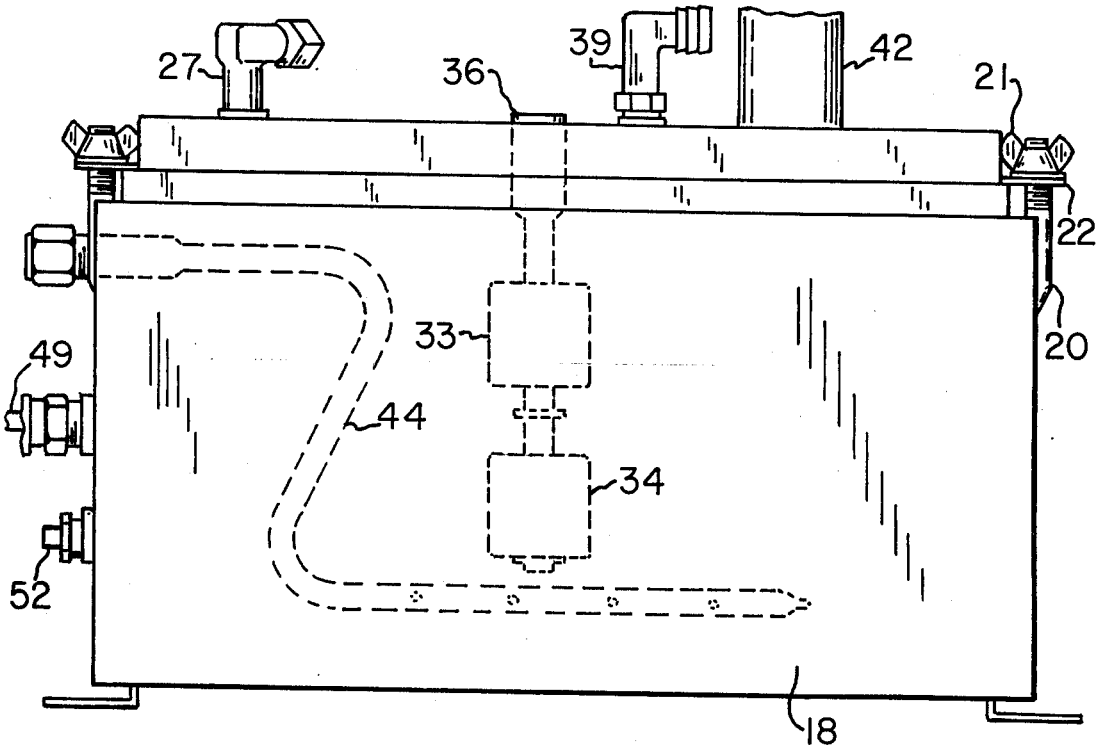
FIG. 4 is an elevational side view of the humidifier.
Figure 5:
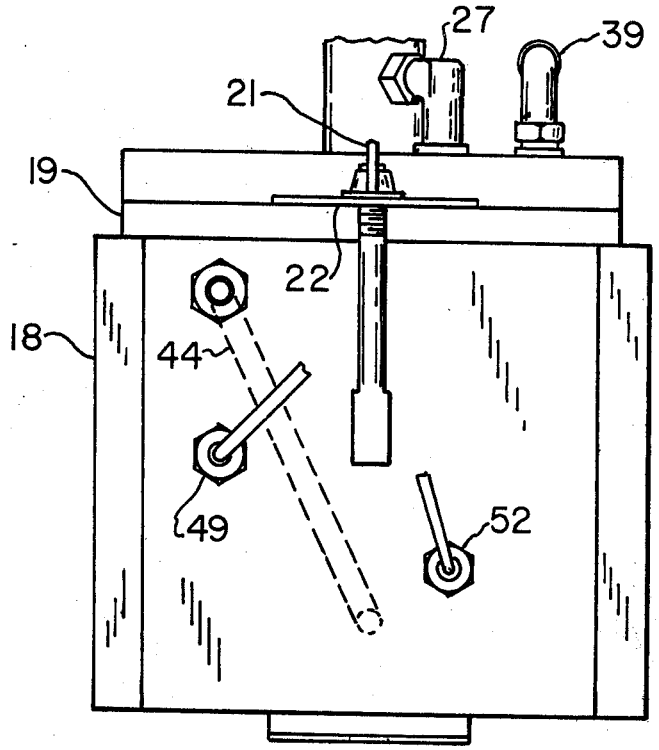
FIG. 5 is an elevational end view of the humidifier.

The system shown in FIG. 1 comprises a test chamber 1 having a gas inlet port 2 for receiving a mixture of gases at appropriate relative humidity from a humidifier 3 constructed according to the present invention. A temperature probe 4 extends into the chamber 1 and provides a direct readout of the chamber temperature. A heater 5 in the humidifier is slaved to heater 6 below the chamber through a control circuit (not shown) which includes temperature probe 7, which is preferably a dual temperature probe, that extends into water jacket 8 of the chamber 1 and a temperature probe 9 which extends into the humidifier. The temperature probe 4 may be used in place of the probe 7 in either a wet or a dry incubator. The heaters are connected to an appropriate power source 10 (preferably 120 v. A.C. 60 Hz).

A predetermined gas mixture, such as air and $CO_2$, is supplied through a pipe 11 to the humidifier 3. The required amount of $CO_2$ is supplied from a tank 12 through a pipe 13 which may include a conventional flow meter 14. The required air is forced into the pipe 11 by an air pump 15. The mixture may be passed through a suitable bacteria filter 16 in the pipe 11. The gas mixture is bubbled through a body of water in the humidifier and delivered through a fluid outlet and conduit 17 to the test chamber 1.

Referring to FIGS. 2–5 of the drawings, a humidifier pursuant to the invention comprises a housing 18, preferably made of stainless steel, having a top cover 19. The cover is removably secured to the housing by threaded pins 20 and wing nuts 21 which engage flanges 22 on the ends of the cover. The cover has a layer of insulation 23 and the walls and bottom of the housing are provided with layers of insulation 24 to prevent thermal losses. The preferred insulation is approximately ½ inch closed cell sponge rubber, but other known insulation materials are also suitable.

The top cover has a plurality of openings in it. A water inlet opening 25 has a feed-through fitting 26 which may be tapped to receive a threaded elbow fitting 27 to which is connected supply pipe 28 from the main water supply (not shown). A solenoid valve 29 is located in the supply pipe 28. The solenoid valve is also electrically connected to the power source 10 and is responsive to a float means 30 within the housing 18 to control the quantity and level of a body of water provided by water admitted to the housing.

A second opening 31 is provided in the top cover and its insulation for holding a common guide rod 32 for electro-magnetic level switches or floats 33 and 34 which are movable on the rod and are separated by a limit ring on the rod. The rod includes a collar 35 which is threaded into a feed-through fitting 36 in opening 31. The collar 35 and rod 32 also serve as insulators for electrical wiring 37 which extends therethrough to the power source 10. Since the details of single station level switches are well known to those skilled in the art, it is unnecessary to further describe them.

The third opening 38 in the top cover 19 and its insulation is for an overflow safety drain tube 39 which is threaded in feed-through fitting 40 sealed in the opening. A suitable drain hose (not shown) may be connected to the drain tube 39. The drain tube extends into the body of water sufficiently to prevent escape of gases when the upper float 33 is at its lowest point on the guide rod 32.

A fourth opening 41 in the top cover and its insulation is the fluid outlet through which the gas mixture, preferably saturated to at least 90% relative humidity, is delivered as conditioned fluid from the humidifier to a test chamber or incubator (not shown). The opening 41 has a feed-through fitting 42 to which is frictionally secured a suitable insulated, flexible hose 43 connected to the test chamber gas inlet port.

A gas bubbler tube 44 extends through a compression fitting 45 engaged in aperture 46 in a sidewall 47 of the preferred humidifier housing. The aperture 46 is located above the highest water level reached in the humidifier. Inside the housing 18, the bubbler tube is bent downwardly and extends along (and preferably spaced slightly from) the bottom and preferably along the center line of the housing. A mixture of gases, such as air and $CO_2$, may be bubbled through the body of water in the housing from holes 48 spaced at the closed end of the bubbler tube 44 adjacent the bottom of the housing.

A temperature probe 49 extends through a compression fitting 50 in aperture 51 in sidewall 47. The probe extends below the level of the body of water in the housing to provide accurate monitoring, and through its associated control circuit, control of water temperature during operation of the humidifier.

Conventional cartridge immersion heater 52 is mounted through a watertight feed-through fitting 53 in aperture 54 below the level of the temperature probe 49. Heater 52 is connected to power supply 10 and is slaved to the heater of the test chamber.

The housing 18 is preferably permanently mounted to a stationary base 55.

In start up, the operator manually selects the desired temperature of the chamber. Water (which is preferably distilled and demineralized) is then admitted to the housing 18 to provide a body of water until the float 34 rises to a point where the immersion heater 52 is below the water level and thus protected against damage. When the immersion heater 52 is below body of water level it is activated to raise the water to an appropriate temperature. The float 33 is carried upwardly by the water level to a preestablished set point where the float deactivates the solenoid valve 29 to stop the supply of water through the pipe 28. Where the desired test chamber temperature is 37° C (body temperature), for example, the temperature in the humidifier housing is continuously monitored by the temperature probe 49. The heater 52 will maintain the humidifier at slightly higher temperature, e.g. +10° to 12° C., the appropriate temperature throughout the operation of the humidifier being under the influence of the control circuit and responsive to the temperature probes of both heaters. The control circuit is basically a comparison circuit of a type which has been used in the electrical arts.

Figure 6:
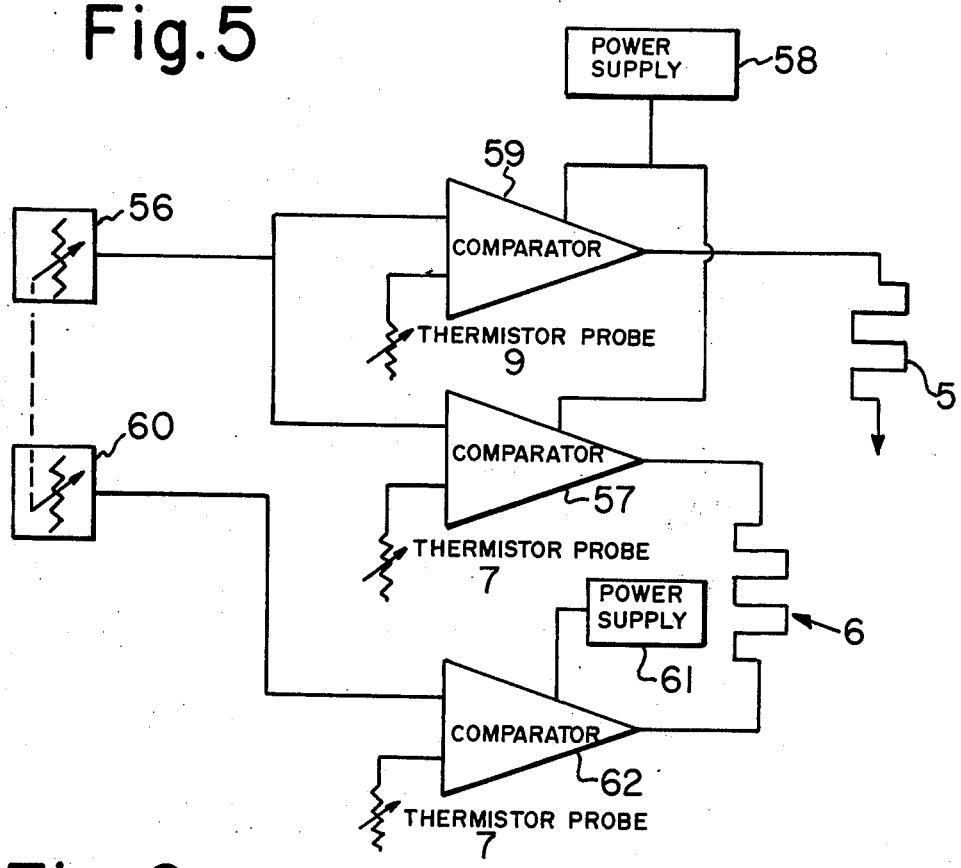
FIG. 6 is a schematic diagram of a preferred form of control circuit useful with the humidifier.

The preferred control circuit, which includes a primary system and a redundant safety backup system for the test chamber, is shown schematically in FIG. 6. In the primary system, a preset temperature signal is operator-programmed by control potentiometer 56. Comparator 57 which has a 12 v. D.C. power supply 58 receives this signal and compares it with signals received from the dual temperature probe 7. If the temperature in the chamber decreases, the preset temperature control signal activates the chamber heater 6 to bring it to the desired temperature. The comparator 59 also is connected to power supply 58. Comparator 59 compares the signals received from temperature probe 9 with the preset temperature signal and derives a control signal which is used to control heater 5 to regulate the temperature of the humidifier to maintain the appropriate test environment.

The backup system includes a preset signal control 60, auxiliary power supply 61 and a comparator 62 to which is connected the dual temperature probe 7. Thus, unlike most backup systems which usually include only one or two components, the backup system provided in the present control circuit is completely redundant, that is, it is capable of operating the chamber heater 6 to protect the specimens against adverse effects even if the primary system fails completely.

The mixture of gases, such as air and $CO_2$, is supplied to the bubbler tube 44 from a source (not shown) and bubbled through the heated body of water, leaving the housing 18 through the fluid outlet as a conditioned fluid comprising an air/gas mixture saturated to approximately 90% relative humidity or greater. The mixture is delivered through the insulated outlet hose 43 to the test chamber.

As water is entrained in the air/gas mixture the quantity and level of the body of water in the humidifier housing is automatically maintained and the temperature is automatically kept substantially constant. When the float 33 drops in response to a lower water level in the humidifier due to evaporation, it actuates the solenoid valve 29 to admit additional water to the housing. The quantity and level of the body of water is thus regulated by the float means and since the temperature probe and cartridge heater are electrically connected through the comparison control circuit and slaved to the chamber heater, the water temperature in the humidifier is automatically regulated to an appropriate temperature to maintain the required environment in the test chamber.

A significant advantage of the present humidifier is that it operates at temperatures below the boiling point of water, thus avoiding the difficulties involved in handling fluids at high temperatures, including thermal losses and avoiding the necessity of expensive insulation and other high-temperature components.

The humidifier can be assembled from conventional materials such as sheet metal, rubber, plastics, and appropriate stock hardware items. The outside surfaces of the housing and top cover can be suitably finished to make the humidifier both a functional and attractive piece of laboratory equipment.

Having described preferred embodiments of the invention, it should be understood that it may be otherwise embodied within the scope of the appended claims.

I claim:

1. A humidifier for conditioning fluid for delivery to a test chamber and which automatically regulates and maintains the quality of said fluid, said humidifier comprising:

A. a closed housing;

B. a water inlet for admitting water into the housing to provide a body of water in the housing;

C. a gas inlet tube for admitting gas into the housing and for bubbling the gas through the body of water;

D. means for heating the body of water to a temperature below the boiling point of water;

E. means for monitoring the temperature of the body of water and for regulating the heating means to maintain a substantially constant temperature within the housing;

F. a fluid outlet for fluid communication with a test chamber for delivering a gas/air mixture to the chamber; and G. means for regulating the quantity and level of the body of water in the housing in response to the amount of water entrained in the gas/air mixture to provide and maintain a preestablished concentration of gas/air mixture with a predetermined relative humidity for delivery to the test chamber.

2. A humidifier as set forth in claim 1 wherein the heating means and the temperature monitoring means are electrically connected through a control circuit, the heating means being responsive to a heater in the test chamber.

3. A humidifier as set forth in claim 1 wherein the means for regulating the quantity and level of the body of water in the housing is a magnetically actuated float adapted to be electrically connected to a solenoid valve for controlling the supply of water into the housing.

4. A humidifier as set forth in claim 1 wherein at least a portion of the gas inlet tube extends adjacent a bottom wall of the housing and includes holes spaced along such portion.

5. A humidifier as set forth in claim 1 and including an overflow tube in said housing for draining excess fluid from the housing.

6. A humidifier for conditioning fluid for delivery to a test chamber and which automatically regulates and maintains the quality of said fluid, said humidifier comprising:

A. a housing having a removable top cover;

B. a water inlet in said cover for admitting water to the housing to provide a body of water in the housing;

C. a gas inlet tube in the housing for admitting gas into the housing, the inlet tube having at least a portion thereof extending adjacent a bottom wall of the housing and having holes spaced along said portion for bubbling gas through the body of water from below the top surface of the body of water;

D. means in the housing for heating the body of water to a temperature below the boiling point of water;

E. means in the housing for monitoring the temperature of the body of water, the heating means being electrically connected to and responsive to the monitoring means to regulate and maintain a substantially constant water temperature within the housing;

F. a fluid outlet in the top cover for fluid communication with a test chamber for delivering a gas/air mixture to the test chamber; and G. float means in the housing responsive to the level of the body of water in the housing, the float means being adapted for electrical connection to a solenoid valve for controlling the admission of water into the housing to provide and maintain substantially constant the quantity and level of the body of water and the preestablished concentration of gas/air mixture with a predetermined relative humidity for delivery to the test chamber.

7. A humidifier as set forth in claim 6 wherein the test chamber includes a heater and the heating means and the temperature monitoring means are electrically connected to each other through a control circuit such that the heating means is responsive to the heater for the test chamber.

8. In combination, a test chamber vented to atmosphere and having a heater for controlling the interior of the chamber and a humidifier for conditioning fluid for delivery to the test chamber and which automatically regulates and maintains the quality of said fluid, said humidifier comprising:

A. a closed housing;

B. a water inlet for admitting water into the housing to provide a body of water in the housing;

C. a gas inlet tube for admitting gas into the housing and for bubbling the gas through the body of water;

D. means for heating the body of water to a temperature below the boiling point of water;

E. means for monitoring the temperature of the body of water and for regulating the heating means to maintain a substantially constant temperature within the housing;

F. a fluid outlet in fluid communication with the test chamber for delivering a gas/air mixture to the chamber; and G. means for regulating the quantity and level of the water in the housing in response to the amount of water entrained in the gas/air mixture to provide and maintain a preestablished concentration of gas/air mixture with a predetermined relative humidity for delivery to the test chamber.

9. The combination as set forth in claim 8 in which the chamber includes a temperature probe for measuring the temperature of the interior of the chamber, the temperature probe and the temperature monitoring means of the humidifier are electrically connected to each other through a control circuit, and the heater of the chamber and the heating means of the humidifier are controlled by the circuit.

* * * * *